United States Patent [19]

Swain

[11] 4,172,624

[45] Oct. 30, 1979

[54] SECURITY PANEL

[75] Inventor: C. Daniel Swain, Tacoma, Wash.

[73] Assignee: Comerco, Inc., Tacoma, Wash.

[21] Appl. No.: 861,017

[22] Filed: Dec. 15, 1977

[51] Int. Cl.[2] ..... A47B 88/16; A47B 77/00

[52] U.S. Cl. ..... 312/292; 312/333; 312/334; 70/86

[58] Field of Search ..... 312/292, 333, 334, 270, 312/296, 314, 350; 70/85, 86; 109/56

[56] References Cited

U.S. PATENT DOCUMENTS

| | | | |
|---|---|---|---|
| 69,068 | 9/1867 | Brada | 312/333 |
| 755,580 | 3/1904 | Parrish | 312/333 |
| 1,052,778 | 2/1913 | Wells | 312/333 |
| 1,653,530 | 12/1927 | Abrachinsky | 312/333 |
| 3,194,623 | 7/1965 | Burgess | 312/333 |
| 3,729,242 | 4/1973 | Barney | 312/330 R |
| 3,738,728 | 6/1973 | Eckard | 312/350 |
| 3,970,010 | 7/1976 | Cantley | 70/85 |

FOREIGN PATENT DOCUMENTS

| | | | |
|---|---|---|---|
| 631496 | 11/1961 | Canada | 312/270 |

*Primary Examiner*—Victor N. Sakran

*Attorney, Agent, or Firm*—Gipple & Hale

[57] ABSTRACT

A security apparatus for a chest of drawers comprising a pair of insert guides, each of the insert guides comprising a planar contact surface capable of being secured to the interior side walls of the chest of drawers, the insert guides extending horizontally and defining horizontally extending grooves. A security panel being slidably received within the grooves and the insert guides have a security panel retention assembly adapted to selectively secure the security panel in a fixed position. Each individual drawer is provided with a suitable locking mechanism, which precludes all individuals other than the individual with the key to the locking mechanism from removing the security panel and having access to the contents contained within the drawer.

4 Claims, 7 Drawing Figures

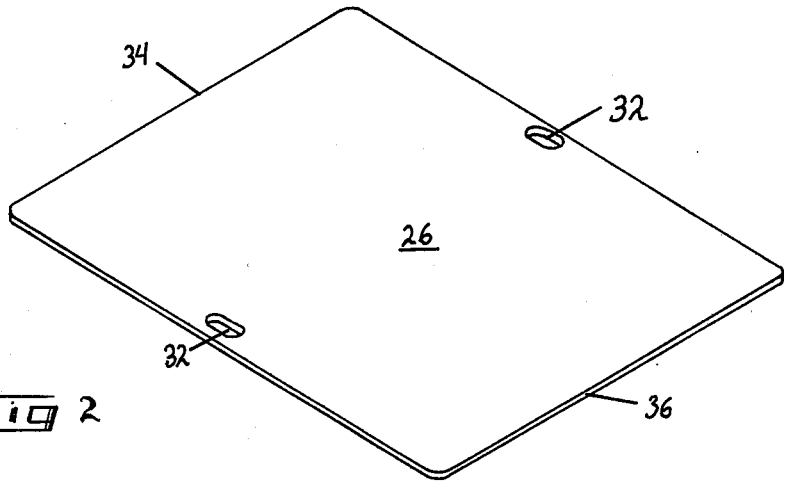
Fig 2
Fig 3
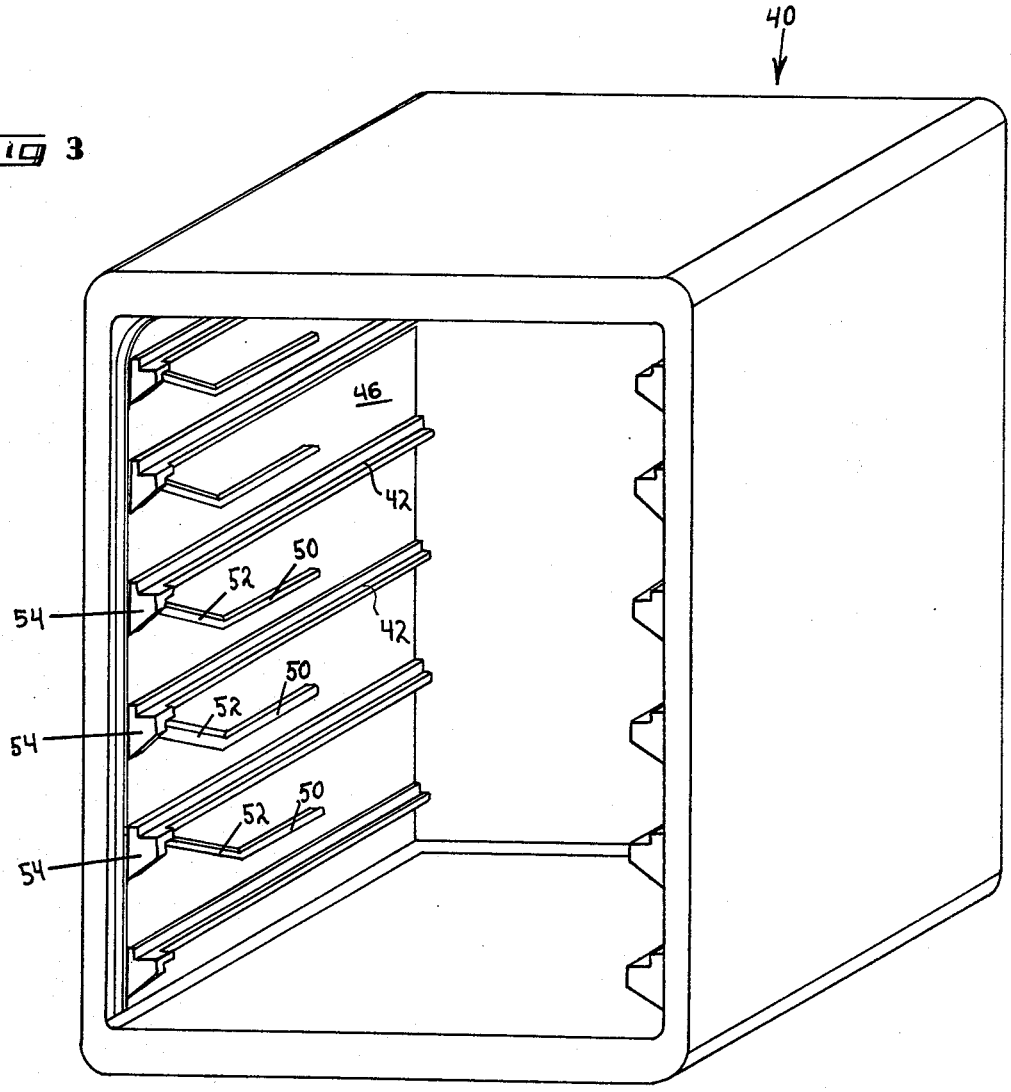

SECURITY PANEL

BACKGROUND OF THE INVENTION

This invention relates to an apparatus for providing security to a plurality of drawers contained in a drawer-support cell. More specifically, the invention comprises a pair of insert guides, which are inserted within a drawer support unit, which rails slidably receive a security panel which, when used in combination with a locking device, precludes all individuals other than the individual with the key to the locking mechanism from removing the security panel and having access to the contents contained within the drawer.

DESCRIPTION OF THE PRIOR ART

Many attempts have been made to provide a security mechanism for a plurality of vertically-arranged drawers. For example, an ordinary executive desk may be provided with a locking mechanism for each drawer. Similarly, file cabinets have been provided with a locking mechanism for preventing the withdrawal of the contents of the cabinet by one other than the authorized individual. The locking mechanisms of the prior art, however, suffer from a basic disadvantage that is alleviated by the present invention. More specifically, the use of a locking mechanism in an executive desk precludes an unauthorized individual from opening the particular drawer to which the locking mechanism is attached. Yet once an individual is given access to a particular drawer, and that drawer is completely removable from the desk, then the individual is consequently given access to the drawer immediately beneath the original drawer. This is a consequence sought to be avoided by the present invention.

As previously mentioned, file cabinets have also been provided with security or locking mechanisms, yet they too suffer from two basic disadvantages. If the file cabinet is provided with a single lock for the entire set of drawers, then all individuals with the key will have complete access to all drawers. Often times, it is necessary for security or other reasons for individuals to have access to only one drawer within a file cabinet and therefore a single locking mechanism does not provide complete security. Additionally, if the file cabinet is provided with a single lock for each drawer, then, as previously described, the entire file drawer could be removed and thereby provide access for the drawer immediately beneath the drawer removed. Here again, complete security has been eliminated. Thus it can be seen that a security mechanism is desirable which allows many individuals to have access to individual drawers without being given access to any other drawers.

A file cabinet or chest of drawers-like structure with this type of security would have many varied uses. For example, a modular cell as hereinafter described, might be extremely useful in a school environment wherein each individual student could be given a key which corresponds to the lock for the drawer for which the student is assigned. Access to the student's drawer would be provided while the invention described precludes the student from gaining access to any other drawer including the drawer immediately beneath the individual's.

The security apparatus and chest of drawers could also have similar utilitarian uses in a hospital environment wherein the individual patients are given a drawer for storing their personal belongings. Here again, the security panel and locking mechanism allow the patient to gain access to his or her particular drawer while precluding the possibility of gaining access to any other patient's drawer and personal belongings.

SUMMARY OF THE INVENTION

The present invention comprises two insert guides which are capable of being fixedly secured within a modular cell unit. The pair of insert guides can be inserted within any file cabinet or chest of drawers-like structures, but, in the preferred embodiment are capable of being secured within a modular cell type unit as will be hereinafter described. The pair of insert guides provide a sliding groove surface for a security panel. The security panel is a flat member which horizontally slides within the grooves provided by the pair of insert guides. The security panel and corresponding insert guide members are secured beneath each drawer within the file cabinet or modular cell unit. A locking device is also provided for precluding the individual drawers from being removed by an unauthorized individual. In the preferred embodiment, a particular locking device is disclosed which is suitable for the modular cell unit as disclosed. The pair of insert guides are each provided with a locking pin mechanism which mechanism allows the individual with access to the particular drawer beneath the security panel to remove the panel when desired.

In operation, the system works like this: a plurality of drawers are located within a file cabinet. Beneath each drawer is a pair of horizontally-extending insert guides. Sliding within the grooves provided by the pair of insert guides is a security panel. The security panel is locked in place by a pair of locking pin mechanisms. The removal of the security panel can only be accomplished by going beneath the security panel. Each individual drawer is provided with a suitable locking mechanism. Thus it can be seen that an individual can unlock his or her drawer and gain access to the contents held within the drawer but is precluded from gaining access to the drawer immediately beneath his or her drawer by removing his or her drawer. The security panel thus serves to separate the drawers into individual secure compartments. While an individual can totally remove his or her drawer from the file cabinet or cell-like structure, he cannot gain access to the contents within the drawer beneath his. Removal of the security panel above one's drawer can only be accomplished by the individual who possesses the key to open the locking mechanism for that particular drawer.

The construction, operation, and advantages of the invention will become more readily apparent and understood from the following detailed specification accompanying the drawings in which:

BRIEF DESCRIPTION OF THE DRAWINGS

FIG. 2 is a perspective view of a security panel;

FIG. 3 is a perspective view of the interior of the modular cell unit;

DETAILED DESCRIPTION OF THE DRAWINGS

Figure 1:
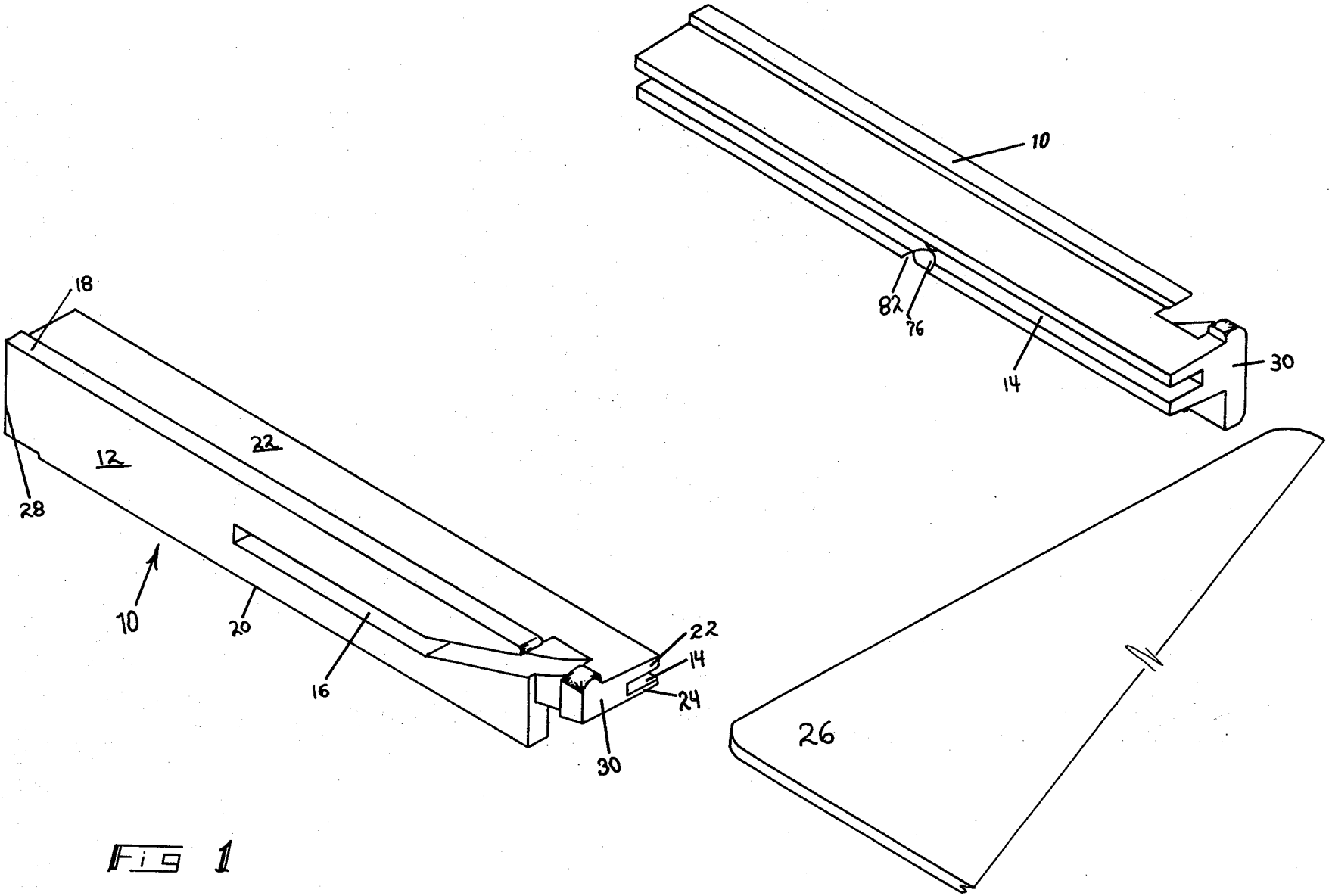
FIG. 1 is a perspective view of a pair of horizontal guides with part of the security panel being shown prior to being slid within the insert guides.

Two horizontal insert guides 10, as best shown in FIG. 1, are mirror images of each other and therefore description of one will serve to fully describe and disclose the other. The insert guide 10 comprises a vertical contact surface 12 and a horizontally-extending groove 14. The vertical contact surface 12 will abut against and contact the vertical inside surface of the file cabinet or other drawer support surface. In the preferred embodiment, a cutout 16 is provided which is adapted to be placed over any inwardly projecting flanges from the inside of the drawer support member and therefore serves to secure the horizontal insert guides in their exact position. The insert guide 10 is provided with a top surface 18 and a bottom surface 20. Extending horizontally yet slightly recessed beneath top surface 18 is the top groove forming member 22. Located beneath the top groove forming member 22 and also extending horizontally from the vertical contact surface 12 is the lower groove forming member 24. The distance between the top groove forming member 22 and the lower groove forming member 24 is slightly greater than the thickness of the security panel 26.

In operation, the wall rails are secured against the vertical walls of the cabinet in a parallel fashion. The grooves 14, parallel to one another, slidably receive the security panel 26. In the preferred embodiment, the insert guides 10 are fixedly secured to the interior of the cabinet by wood screws, welding, or other suitable conventional fastening means.

The insert guides are further defined by the rear surface 28 and the front surface 30, the distance between the two being less than the depth of the cabinet or cell-like structure within which the insert guides are secured.

As best seen in FIG. 2, the security panel 26 is rectangular and provided with two apertures 32 located approximately at the midway point between the leading edge 34 and the following edge 36 of the security panel. The width of the security panel 26 is sufficient to extend between the pair of horizontally-extending insert guides 10. As previously mentioned, the thickness of the security panel 26 is small enough so as to allow the security panel to easily slide within the grooves 14 of the insert guides 10.

A chest of drawers, bureau, or modular cell unit 40, is generally provided with a plurality of horizontally-extending support rails 42. The horizontally-extending support rails 42 provide convenient gliding surfaces for a drawer 44. The horizontally-extending support rails 42 extend internally from the side walls 46 of the chest of drawers or modular cell unit 40. A drawer 44, as best shown in FIG. 5, is generally provided with a pair of flanges 48 which flanges glide upon the horizontal support rails 42.

In the preferred embodiment, the support rails are provided with associated stabilizer arms 50 which arms extend interiorly from the side walls 46 of the chest of drawers or modular cell unit 40. The stabilizer arms 50 serve to provide a flat surface for the upper surface of the flanges 48 of the drawer 44 to glide beneath. The stabilizer arm 50 is connected to the horizontal support rail immediately above the support rail which it serves by an inclined leg 52. Thus, it can be seen that the flange 48 of the drawer 44 slides between the stabilizer arm 50 and the horizontal support rail immediately beneath it. FIG. 1 clearly shows the insert guide 10, with the cutout 16, specifically adapted to be secured over the incline leg 52 and stabilizer arm 50, as the preferred embodiment of the invention. The top surface 18 and bottom surface 20 of the insert guide 10 will rest between the horizontal support rail 42 and the immediately adjacent horizontal rail.

Figure 5:
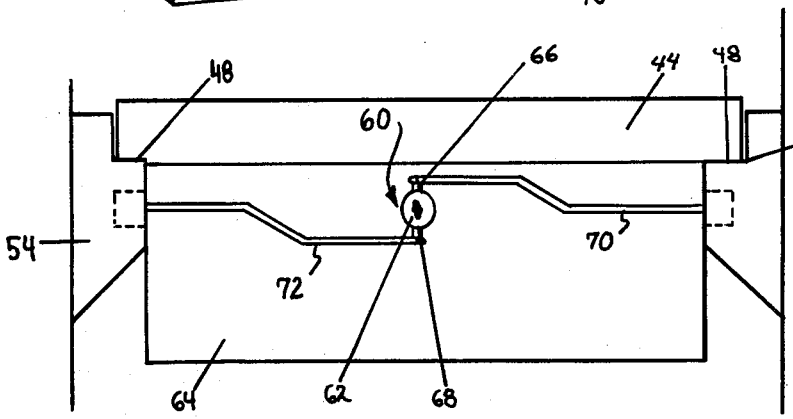
FIG. 5 is a front view of a drawer supported on glide rails with its associated locking mechanism.

As best seen in FIG. 5, a locking mechanism 60 is provided, which serves to preclude the unauthorized withdrawal of a particular drawer from the chest of drawers or modular cell unit 40. The locking mechanism can be of any conventional means. In the preferred embodiment, however, the locking mechanism comprises a lock 62 which is located in the center front face 64 of the drawer 44. The lock 62 is connected via short arms 66 and 68 to a pair of linkage arms 70 and 72. The linkage arms 70 and 72 are adapted to be secured behind vertical planar surfaces of locking blocks 54. The locking blocks 54 project inwardly from the interior side walls 46 of the modular cell unit 40. It can be seen that rotation of the lock 62, by the appropriate key, forces the short arms 66 and 68 to rotate about the pivot point or lock 62 and consequently serves to retract the linkage arms 70 and 72 from behind the vertical planar surfaces of the locking blocks 54. In operation, when it is desired to remove the drawer from the chest of drawers or modular cell unit 40, the appropriate key is inserted into the lock 62 and rotated until the linkage arms 70 and 72 are retracted from behind the vertical planar surfaces of the locking blocks 54. In this manner, the drawers can be easily removed by the authorized individual.

Figure 4:
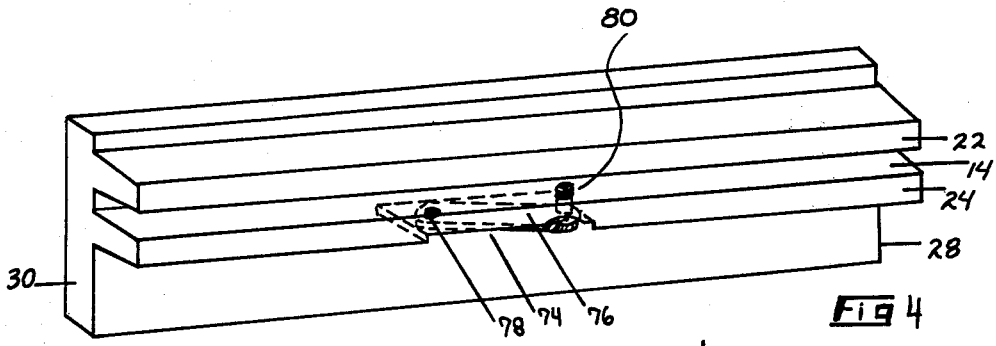
FIG. 4 is a perspective view of one of the horizontal insert guides.

FIG. 4 discloses a retaining mechanism for securing the security panel to the insert guides. The retaining mechanism 74 comprises a spring clip 76 which is secured to the insert guide 10 by a rivet or other conventional fastening means 78. The spring clip 76 is provided with an upwardly-protruding pin 80 which passes through the lower groove-forming member 24. A finger hole 82, preferably semicircular, is cut into the lower groove-forming member 24 and provides an aperture which allows the authorized individual's finger to depress the spring clip 76 of the retaining mechanism 74 and thereby release the pin 80 from passing through the apertures 32 of the security panel 26. By depressing the spring clip 76, as just mentioned, the security panel can be removed by an individual. Due to the fact that the retaining mechanism is located beneath the groove 14 and, consequently, beneath the security panel 26, only that authorized individual who has access to the drawer immediately beneath the security panel may remove that security panel. This completely eliminates the possibility of an individual removing his or her drawer and thereby creating immediate access to the drawer and articles stored immediately beneath his or her now-removed drawer.

Figure 6:
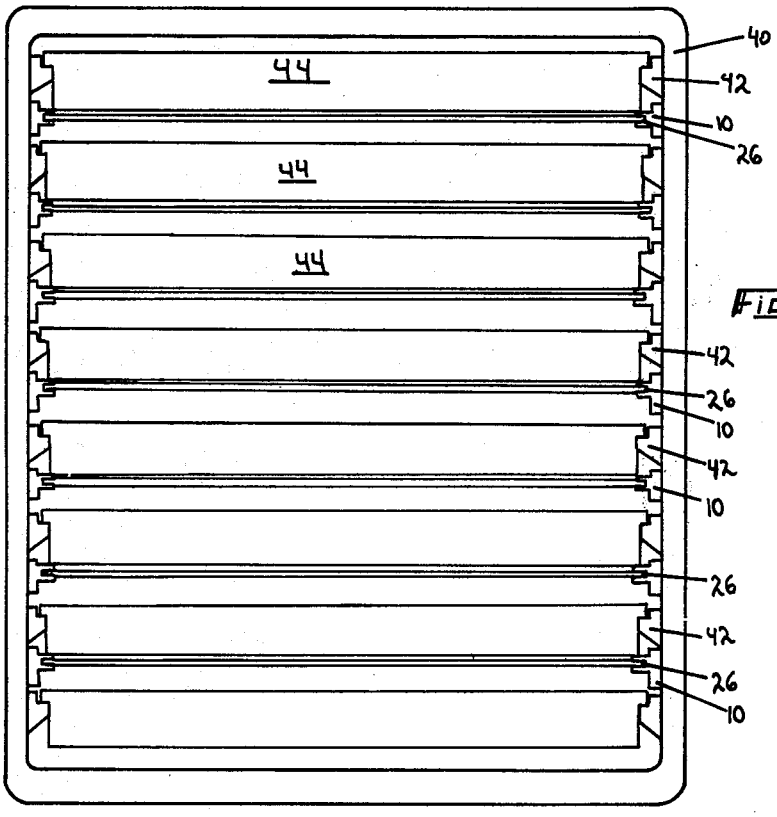
FIG. 6 is a front end view of a modular cell unit with drawers and security panels in place.
Figure 7:
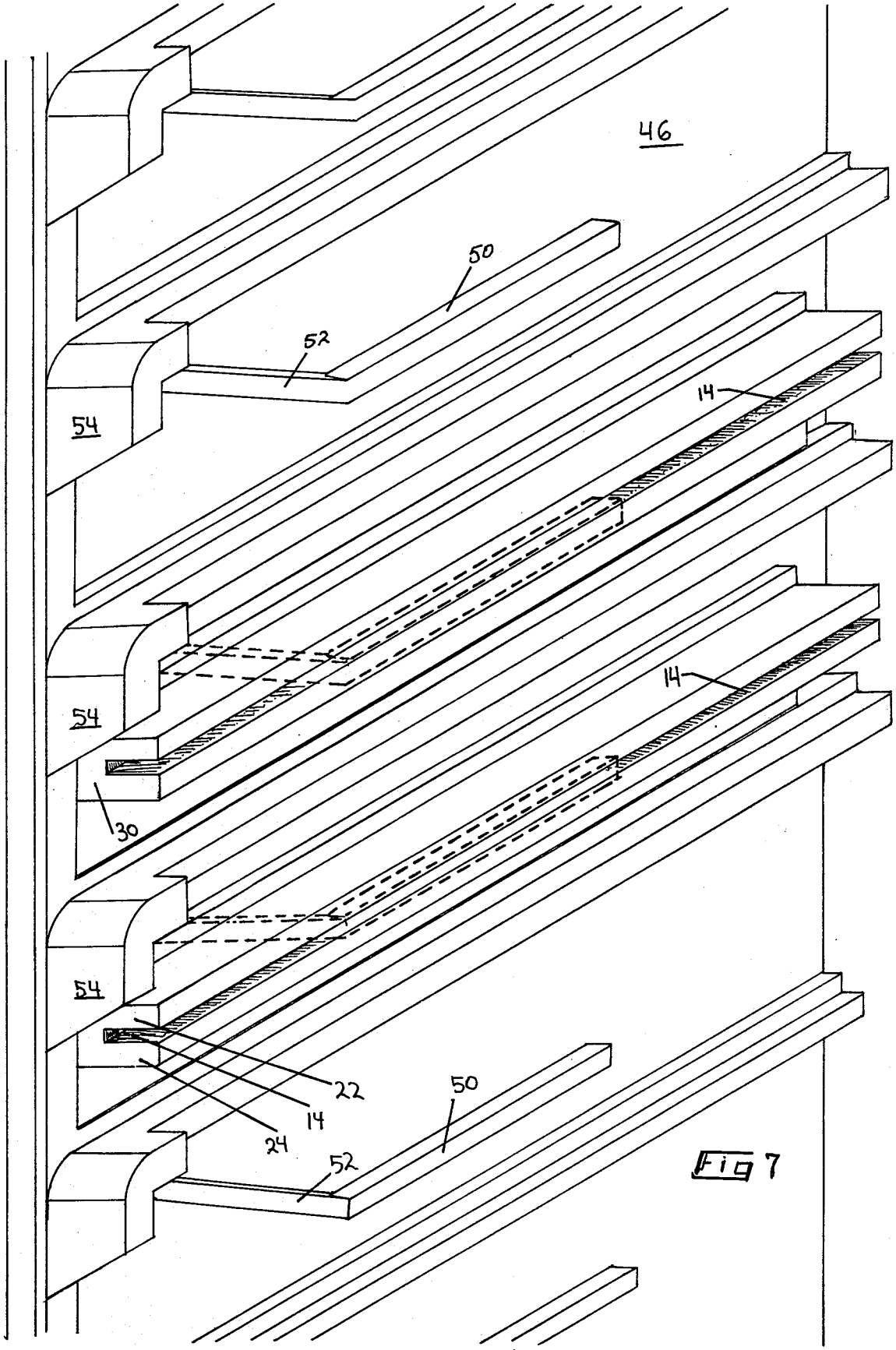
FIG. 7 is an enlarged perspective view of the interior of the modular cell unit with two horizontal insert guides being shown in place.

In operation, as best seen in FIGS. 5, 6 and 7, a plurality of drawers 44 are contained within a chest of drawers or modular cell unit 40. These drawers 44 are supported and glide upon support rails 42 which project inwardly from the interior side walls 46 of the modular cell unit 40. Each individual drawer is provided with its own associated locking mechanism 60 which precludes the drawer from being removed by any unauthorized individual. Removal of the drawer will only occur when the proper key is inserted into the lock 62. The interior walls of the modular cell unit are provided with corresponding pairs of insert guides 10 which fit over the inclined leg 52 and stabilizer arms 50 and are secured to the walls by conventional fastening means. In this manner, a horizontally-extending groove 14 is provided which is adapted to slidably receive the security panel 26. The security panel 26 is slid within the grooves 14 until the apertures 32 of the security panel 26 are positioned above the pin 80 of the spring clip 76. At this point, the pin 80 will protrude through the apertures 32 of the security panel and prevent the security panel from being pushed further into the modular cell unit 40. Withdrawal of the security panel can only be accomplished by the authorized individual reaching beneath the insert guides and, more specifically, the lower groove-forming member 24, and depressing the spring clip 76 through the finger holes 82. With the spring clip 76 and associated pin 80 depressed, the security panel can now be removed.

In operation, each drawer 44 is provided with its own locking mechanism 60, as mentioned, and its own security panel and insert guides 10 immediately above the drawer. When an individual opens the lock and removes the drawer from within the cavity, the individual is precluded from reaching down into the drawer immediately beneath it by the security panel 26. Only the individual who has authority to open a particular drawer can remove the security panel located immediately above the open cavity of the drawer. This is accomplished by the novel configuration of the security panel and the retaining mechanism 74.

Thus, it has been shown that a chest of drawers or modular cell unit is disclosed, which allows individuals complete accessibility to his or her particular drawer while providing complete security for the other individuals' drawers and personal belongings.

While the preferred embodiment of the invention has been disclosed, it is understood that the invention is not limited to such an embodiment since it may be otherwise embodied in the scope of the appended Claim.

What is claimed is:

1. A security apparatus for a chest of drawers comprising a pair of insert guides, each of said insert guides comprising a planar contact surface capable of being secured to the interior side walls of said chest of drawers, said insert guides extending horizontally and defining a horizontally extending groove and a finger hole, a security panel being slidably received within said grooves, said insert guides having security panel retention means adapted to selectively secure said security panel in a fixed position, said retention means comprises a pair of upwardly biased spring clips having upwardly protruding pin members which protrude through side apertures defined by said security panel located about midway between the leading and trailing edge of said security panel to hold said security panel in retention, each of said upwardly biased spring clips being located beneath said grooves of said insert guide with protruding pin members passing partially through said grooves and adjacent said finger holes, said finger holes providing access to said upwardly biased spring clips to facilitate releasing of said retention means, and individual locking means for securing each of said drawers within said chest of drawers, said locking means comprising a tumbler lock secured to the front face of said drawers, said lock being connected to linkage arms, the ends of which, when the tumbler lock is in its locking position, are placed behind locking blocks located and secured to said chest drawers.

2. A security-providing apparatus for a plurality of vertically stacked drawers, comprising a pair of horizontally extending insert guides which are adapted to be fixedly secured along the interior side walls of a support structure for said drawers, said insert guides defining cutout portions which matingly engage protrusions from the side walls of said support structure to secure said insert guides in predetermined positions and horizontally-extending grooves for slidably receiving a security panel, a security panel defining side apertures capable of sliding between said grooves and serving to prevent an individual with access to a second drawer immediately beneath the first drawer, said insert guides having security panel retention means adapted to selectively secure said security panel in a fixed position within said grooves, and said security panel retention means comprising an upwardly biased spring clip with an upwardly protruding pin means, said pin means when the security panel is inserted between said grooves passing through said side apertures to lock said security panel in position, said retention means being releasable only from beneath said security panel, and locking means for securing said drawers within said support structure, said locking means comprising individual tumbler locks adapted to prevent the unauthorized removal of said drawers from said support structure, said tumbler locks being pivotally secured to the front face of said drawers and provided with linkage arms which move when said lock is rotated to abut against the support structure for said drawers, said support structure for said drawers including locking blocks, said locking blocks providing a vertical planar surface for said linkage arms to recess behind preventing the unauthorized removal of said drawers from said drawer support structure.

3. A security providing apparatus as claimed in claim 2, wherein said security panel retention means can be released by depressing said upwardly biased spring clip means, access to which can only be obtained by reaching beneath said security panel.

4. A security providing apparatus as claimed in claim 3, wherein access to said upwardly biased spring clip means is facilitated by finger holes located on said insert guides.

* * * * *